United States Patent [19]

Greve et al.

[11] 4,132,189

[45] Jan. 2, 1979

[54] APPARATUS FOR APPLYING PLASTICIZER TO FIBROUS FILTER MATERIAL IN FILTER ROD MAKING MACHINES

[75] Inventors: Heinz Greve; Peter Grumer; Rolf Gömann, all of Hamburg, Fed. Rep. of Germany

[73] Assignee: Hauni-Werke Körber & Co. KG., Fed. Rep. of Germany

[21] Appl. No.: 255,032

[22] Filed: May 19, 1972

[30] Foreign Application Priority Data

| | | | |
|---|---|---|---|
| Sep. 20, 1971 | [DE] | Fed. Rep. of Germany | 2146897 |
| Jun. 2, 1971 | [DE] | Fed. Rep. of Germany | 2127293 |
| Dec. 1, 1971 | [DE] | Fed. Rep. of Germany | 2159428 |

[51] Int. Cl.[2] ..... B05C 5/00

[52] U.S. Cl. ..... 118/8; 118/44; 118/62; 118/325; 118/326; 118/DIG. 16

[58] Field of Search ..... 118/44, 62, 325, 326, 118/8, DIG. 16, 50, DIG. 19; 19/66 T, 65 T; 28/75 R; 68/205 R

[56] References Cited

U.S. PATENT DOCUMENTS

| | | | |
|---|---|---|---|
| 275,957 | 4/1883 | Stonemetz | 118/325 X |
| T874,005 | 5/1970 | Fritz et al. | 118/325 X |
| 2,736,289 | 2/1956 | Allen | 118/325 X |
| 2,775,952 | 1/1957 | Schur | 118/325 X |
| 2,844,019 | 7/1958 | Schurmann et al. | 68/205 |
| 2,986,149 | 5/1961 | Van Brakel | 68/205 R X |
| 3,209,467 | 10/1965 | Taylor, Jr. | 19/66 T X |
| 3,226,773 | 1/1966 | Paliyenko | 118/325 X |
| 3,387,992 | 6/1968 | Arthur et al. | 118/325 X |
| 3,566,451 | 3/1971 | Weigand | 19/66 T |
| 3,591,450 | 7/1971 | Murphy et al. | 19/66 T X |

*Primary Examiner*—John P. McIntosh
*Attorney, Agent, or Firm*—Peter K. Kontler

[57] ABSTRACT

A filter rod making machine wherein a continuous tow of fibrous filter material is flattened to form a foraminous layer prior to passage through an impregnating station where an atomizing nozzle or a revolving brush sprays particles of atomized plasticizer against one side of the layer. An intercepting plate is placed in contact with the layer opposite the nozzle or brush so that the particles which penetrate across the layer and reach the plate are entrained by successive increments of the layer to thus insure that each unit length of the layer contains the same quantity of plasticizer. The rate of delivery of plasticizer to the brush or nozzle is changed in automatic response to changes in forward speed of the layer.

15 Claims, 6 Drawing Figures

APPARATUS FOR APPLYING PLASTICIZER TO FIBROUS FILTER MATERIAL IN FILTER ROD MAKING MACHINES

BACKGROUND OF THE INVENTION

The present invention relates to machines for the manufacture of filter rods of the type which are used for the production of filter plugs or filter rod sections in the making of filter-tipped cigarettes, cigars or cigarillos. More particularly, the invention relates to improvements in apparatus which are used in filter rod making machines to apply a liquid plasticizer to successive increments of a continuously moving tow of filamentary filter material.

A filter rod making machine normally comprises a feeding or advancing mechanism which draws a continuous tow of filamentary filter material from a bale and transports the tow lengthwise through an impregnating station where the filaments are contacted by particles of a liquid plasticizer or softening agent. Prior to entering the impregnating station, the tow is caused to pass through one or more so-called banding devices wherein the tow is converted into a layer so as to expose all or nearly all of its filaments during travel through the impregnating station. The thus impregnated layer is thereupon caused to pass through a gathering device (called horn) which converts the layer into a rod-like filler to be thereupon wrapped into a web of cigarette paper or other suitable wrapping material to complete the conversion of the tow into a continuous filter rod. The rod is thereupon severed at regular intervals to yield filter rod sections or plugs of unit length or multiple unit length. The tow normally consists of cellulose fibers, and the purpose of the plasticizer is to soften portions of the surface on each filament so that the thus softened portions adhere to each other and form an integral network of filaments.

A drawback of presently known impregnating apparatus in filter rod making machines is that they are incapable of insuring that each increment or unit length of the tow contains the same quantity of plasticizer. As a rule, a conventional impregnating apparatus simply sprays atomized plasticizer against one side of the travelling layer of fibrous filter material and employs a suction nozzle which collects and leads away the particles of plasticizer which failed to adhere to the filamentary material. During further processing of filamentary material downstream of the impregnating station, a portion of the plasticizer evaporates and the remainder of the plasticizer hardens. The hardening or setting is completed simultaneously with subdivision of the filter rod into sections of desired length. If the quantity of plasticizer varies from unit length to unit length of the rod-like filler of filamentary filter material, the hardness of corresponding filter plugs also varies from plug to plug. The processing of filter plugs of non-uniform hardness presents serious problems, especially since the machinery which receives and further transports and processes filter plugs which are furnished by the filter rod making machine is not adjustable to compensate for variations in the hardness of plugs which are thereupon united with sections of wrapped tobacco particles to form filter cigarettes, cigarillos or cigars. As a rule, a relatively soft filter plug or section is more difficult to manipulate and is more likely to undergo permanent deformation or to be destroyed during treatment in a filter cigarette making machine or the like. Excessive deformation of a single relatively soft filter plug can cause lengthy interruptions in the operation of an entire production line with attendant losses in output.

SUMMARY OF THE INVENTION

An object of the invention is to provide a filter rod making machine with a novel and improved apparatus which is capable of insuring uniform application of a liquid plasticizer to successive increments of a foraminous layer of fibrous filter material.

Another object of the invention is to provide an impregnating apparatus which can be readily incorporated in existing filter rod making machines.

A further object of the invention is to provide the impregnating apparatus with novel and improved means for insuring uniform distribution of atomized plasticizer in each and every zone of a continuously moving foraminous layer of filamentary filter material.

Still another object of the invention is to provide a filter rod making machine which embodies the improved impregnating apparatus and is capable of turning out a succession of filter rod sections or plugs each of which has the same hardness so that the processing of such filter rod sections or plugs presents no serious problems during transport to and during treatment in filter cigarette making or analogous consuming machines.

The invention resides in the provision of an apparatus for applying fluid plasticizer to the filaments in layers of fibrous filter material. The apparatus comprises advancing means for moving a foraminous layer of fibrous filter material along a predetermined path toward, through and beyond an impregnating station, a source of plasticizer, an atomizing device (for example, a rotary brush or nozzle) which is located at the impregnating station at one side of the path and is connected with the source so as to direct against successive increments of the moving layer at the impregnating station particles of finely distributed plasticizer whereby some of the particles adhere to the filaments and the remaining particles penetrate across the moving layer, and intercepting means having a surface immediately adjacent to the path opposite the atomizing device so that successive increments of the moving layer sweep along such surface and entrain at least some but preferably all of the remaining particles.

The advancing means for the layer of fibrous filter material preferably includes variable speed drive means, and the impregnating apparatus preferably further comprises means for regulating the rate of delivery of plasticizer from the source to the atomizing device as a function of changes in the speed of the layer at the impegnating station.

The novel features which are considered as characteristic of the invention are set forth in particular in the appended claims. The improved impregnating apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
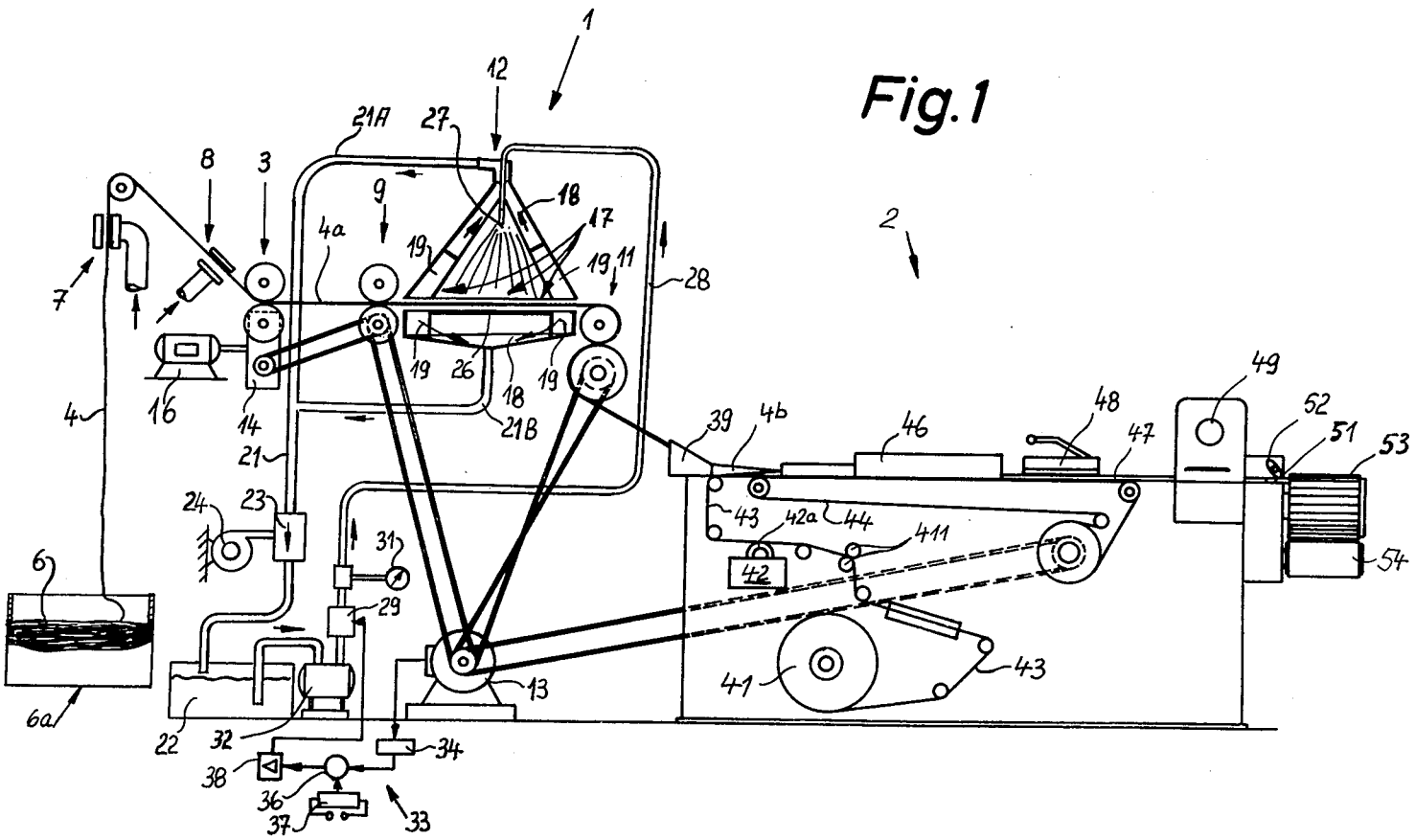
FIG. 1 is a schematic partly elevational and partly sectional view of a filter rod making machine including an impregnating apparatus which embodies one form of the invention.

The filter rod making machine of FIG. 1 comprises two main units, namely, a filter tow processing or impregnating apparatus 1 and a filter rod section making unit or apparatus 2. The apparatus 1 is similar to that known as type AF produced by the firm Hauni-Werke, Hamburg-Bergedorf, Western Germany. This apparatus comprises a source 6*a* of raw filter tow 4 which is stored in the source 6*a* in the form of a bale 6. The tow 4 is thereupon converted into a layer whose filaments are impregnated with a suitable plasticizer, and the thus treated layer is converted into a rod-like filler which enters the filter rod section making apparatus 2. The apparatus 2 is of the type known as KDF 2, also produced by the West-German firm of Hauni-Werke. The apparatus 2 converts the rod-like filler into a wrapped filter rod which is thereupon severed at regular intervals to yield a succession of filter rod sections or plugs ready to be transported into storage or directly to a consuming machine, such as a filter cigarette making machine.

The impregnating apparatus 1 further comprises a pair of tow feeding or advancing rolls 3 which serve to advance the raw tow 4 from the source 6*a* toward an impregnating station 17. Prior to reaching the advancing rolls 3, successive increments of the raw tow 4 pass through a pair of pneumatic banding devices 7 and 8 of known design. The purpose of the banding devices 7 and 8 is to convert the tow 4 into a flat and wide foraminous or fluid-permeable layer of filamentary filter material before the layer reaches the advancing rolls 3, i.e., before the layer enters the impregnating station 17. An advantage of the banding devices 7 and 8 is that they expose all or nearly all filaments of the foraminous layer to particles of liquid plasticizer to thus insure more uniform distribution of such particles and uniform hardness of each portion of a finished filter rod section. The nozzles of the banding devices 7 and 8 receive streams of compressed air and discharge streamlets of compressed air through a plurality of orifices whereby such streamlets loosen the filaments of the tow 4 by simultaneous conversion of the tow into a flat layer shown at 4*a*.

The advancing rolls 3 are followed by a second pair of rolls 9, known as spreading rolls, which are preferably driven at a speed exceeding the speed of the rolls 3 so that the filaments of the layer 4*a* are stretched during travel toward the impregnating station 17. This also contributes to a separation of fibers from each other and effects an additional loosening of the filamentary material. The spreading rolls 9 are located upstream of the impregnating station 17, and this station is followed by a third set of rolls 11 which act as deflectors and guide treated increments of the layer 4*a* into a gathering funnel or horn 39 of the filter rod section making apparatus 2.

The impregnating station 17 accommodates an impregnating device 12 which is located between the pairs of rolls 9 and 11 and includes an atomizing nozzle 27 serving to discharge a cloud or spray of atomized particles of liquid plasticizer against the upper side of the layer 4*a* at the impregnating station.

One roll of each of the pairs of rolls 9 and 11 is preferably provided with circumferential grooves and the other roll of each of these pairs of rolls is preferably provided with a smooth peripheral surface and an elastic outer layer which defines such smooth surface. The just described configuration and construction of the rolls 9 and 11 further contributes to proper spreading and loosening action upon the filaments of the layer 4*a* at the impregnating station 17. The pairs of rolls 3, 9 and 11 are driven by a common main prime mover 13 which is preferably a variable-speed electric motor and drives the rolls through the intermediary of suitable chain or belt transmissions. The drive means for the lower roll 3 includes a transmission 14 whose speed can be regulated by a variable-speed electric motor 16 so as to insure that the rolls 3 can be driven at a speed which is less than the speed of the rolls 9 with attendant stretching of the layer 4*a* between the rolls 3 and 9. The manner in which the motor 16 can regulate the ratio of the transmission 14 is disclosed in the copending application Ser. No. 4,018, filed Jan. 19, 1970 by Hans-Jürgen Block and owned by the assignee of the present application.

In addition to the aforementioned atomizing nozzle 27, the impregnating device 12 at the station 17 further includes a receptacle 18 having portions located above and below the path of the layer 4*a* between the rolls 9 and 11. The receptacle 18 serves to collect the surplus of plasticizer which might not adhere to successive increments of the layer 4*a* during travel of such increments through the impregnating station 17. The receptacle 18 defines a suction chamber wherein the pressure is preferably only slightly less than atmospheric pressure but is sufficient to cause the evacuation of surplus plasticizer by way of a return conduit or suction line 21. It will be noted that the suction line 21 has two branches 21A and 21B which are respectively connected to the suction chambers in the upper and lower portions of the receptacle 18. The reference characters 19 denote suction channels in the receptacle 18 which serve to guide the collected surplus plasticizer into the branches 21A, 21B of the suction line 21.

The impregnating apparatus 1 further comprises a vessel or tank 22 containing a main supply of liquid plasticizer. The discharge end of the return conduit 21 delivers the collected surplus plasticizer back into the tank 22. The conduit 21 contains an air separator 23 which is connected with a suction generating fan 24. The purpose of the fan 24 is to withdraw air from the plasticizer in the return conduit 21 and also to create the necessary subatmospheric pressure in the chambers of the receptacle 18 at the impregnating station 17.

In accordance with a feature of the invention, the impregnating apparatus 1 further comprises an intercepting plate 26 which is installed in the lower portion of the receptacle 18 and is immediately adjacent to the underside of the path for the layer 4*a* between the pairs of rolls 9 and 11. Thus, the underside of the layer 4*a* sweeps along the upper surface of the intercepting plate 26 so that successive increments of the layer entrain all such particles of plasticizer which are discharged by the atomizing nozzle 27 and penetrate through the layer at the impregnating station 17. This insures that each increment of the layer 4a which leaves the impregnating station 17 contains the same quantity of plasticizer which, in turn, insures that the hardness of filter plugs or filter rod sections which are produced in the apparatus 2 is always within the desirable range.

The atomizing nozzle 27 is mounted at the discharge end of a supply conduit 28 which contains a motor-driven pump 32, preferably a gear pump, and dips into the supply of plasticizer in the tank 22. The supply conduit 28 further contains a flow regulating device 29 here shown as an adjustable flow restrictor which is mounted in the conduit 28 downstream of the pump 32. A pressure gauge 31 is connected with the conduit 28 immediately downstream of the flow restrictor 29 to indicate the pressure of plasticizer flowing toward the atomizing nozzle 27. A control circuit 33 for the adjustable flow restrictor 29 includes a tachometer generator 34 which furnishes signals having an intensity indicative of the speed of the main prime mover 13 to a signal comparing junction 36. The junction 36 further receives a signal from a rated value selector 37 (preferably an adjustable potentiometer), and the junction 36 furnishes signals to an amplifier 38 having an output connected with the flow restrictor 29. Thus, the rate at which the flow restrictor 29 admits liquid plasticizer into the atomizing nozzle 27 is always a function of the speed of the motor 13 and therefore a function of the speed of the layer 4a at the impregnating station 17. The control circuit 33 insures that the quantity of plasticizer which is applied to unit lengths of the layer 4a remains unchanged regardless of the speed of the layer 4a at the impregnating station 17. When the speed of the motor 13 is increased, the signal from the tachometer generator 34 causes the junction 36 to furnish to the flow restrictor 29 a signal which causes the flow restrictor to admit larger quantities of plasticizer to the atomizing nozzle 27. Inversely, the rate of fluid flow in the supply conduit 28 is reduced if the speed of the motor 13 is reduced. The provision of the receptacle 18 constitutes an optional feature of the apparatus 1 because, as a rule, the intercepting plate 26 insures that all or nearly all particles of atomized plasticizer are entrained by the layer 4a during travel through the impregnating station 17.

The freshly treated increments of the layer 4a thereupon advance between the rolls 11 and are introduced into the gathering funnel or horn 39 to be converted into a rodlike filler 4b which thereupon enters a wrapping mechanism 46 of the apparatus 2. The apparatus 2 further comprises a bobbin 41 of convoluted cigarette paper 43 or analogous wrapping material which is drawn from the bobbin 41 by a pair of advancing rolls 411 and moves with its underside along a rotary applicator 42a forming part of a paster 42 before the web of paper 43 enters the wrapping mechanism 46. This mechanism includes an endless garniture belt 44 which transports the web of cigarette paper 43 lengthwise together with the filler 4b during draping of the web around the filler 4b so as to form a continuous wrapped filter rod 47. The seam which is formed by the overlapping marginal portions of the tube obtained on conversion of the web of cigarette paper 43 in the mechanism 46 is thereupon heated by a sealer 48 so as to cause rapid setting of adhesive in order to insure that the tubular wrapper of the rod 47 will not open during further processing. The sealer 48 is followed by a conventional cutoff 49 which subdivides the rod 47 into filter plugs or filter rod sections 51 of unit length or multiple unit length. Successive filter rod sections 51 are accelerated by a kicker (such as a rotary cam) 52 which increases the distance between successive filter rod sections 51 and propels the sections into successive flutes of a rotary transfer drum 53. The drum 53 converts the single file of filter rod sections 51 into one or more rows of filter rod sections which move sideways and are transferred onto an endless belt 54 which transports the filter rod sections to a tray filling apparatus or directly to a consuming machine, such as a filter cigarette making machine.

Figure 2:
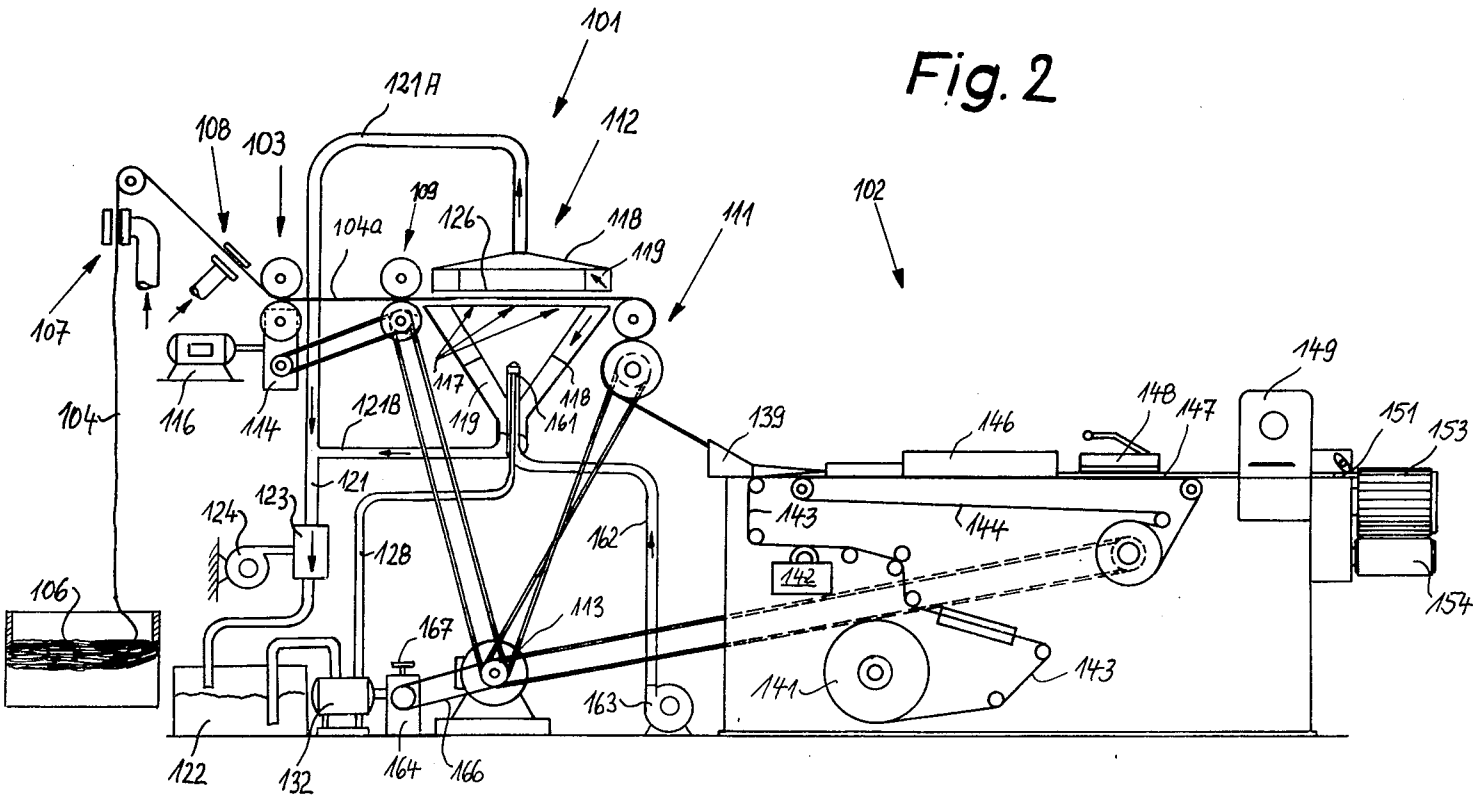
FIG. 2 is a similar partly elevational and partly sectional view of a filter rod making machine which embodies a modified impregnating apparatus.

The filter rod making machine of FIG. 2 is similar to the machine of FIG. 1, and all such components of the machine of FIG. 2 which are clearly analogous to or identical with the corresponding components of the first machine are denoted by similar reference characters plus 100. One difference between the two machines is that the impregnating apparatus 101 of FIG. 2 includes an atomizing nozzle 161 which is located at the underside of the path of the layer 104a travelling between the rolls 109 and 111. Consequently, the intercepting plate 126 is installed in the upper portion of the receptacle 118 above the path for the layer 104a and opposite the discharge end of the atomizing nozzle 161. The flow restrictor 29 of FIG. 1 is omitted. Instead, the gear pump 132 in the supply conduit 128 for liquid plasticizer is driven by a transmission 164 which, in turn, is driven by the main prime mover 113 through the intermediary of a toothed belt 166. The ratio of the transmission 164 can be selected by a hand wheel 167 or an analogous adjusting device.

The atomizing nozzle 161 of the impregnating device 112 at the station 117 is further connected with the discharge end of a conduit 162 which receives compressed air from a blower 163 or an analogous source. The adjustment of the blower 163 is such that it furnishes to the nozzle 161 a stream of compressed air at a constant pressure. When the operator or an automatic adjusting or control system changes the speed of the main prime mover 113, the speed of the output element of the transmission 164 is automatically changed through the intermediary of the belt 166 so that the output of the variable-delivery pump 132 fluctuates as a function of changes in the speed of the layer 104a. Since the pressure of compressed air in the conduit 162 is constant, the rate at which the nozzle 161 discharges atomized plasticizer against the underside of the layer 104a at the impregnating station 117 varies at the same rate as the speed of the prime mover 113. This again insures that each increment of the layer 104a carries away the same quantity of finely atomized plasticizer as the preceding increment or increments. Otherwise, the construction of the impregnating apparatus 101 and the filter rod section making apparatus 102 of FIG. 2 is identical with the construction of the corresponding apparatus shown in FIG. 1.

Each of the heretofore described impregnating apparatus exhibits its own advantages. Thus, the apparatus 1 or 101 exhibits the advantage that the nozzle 27 or 161 is capable of furnishing a spray of very finely distributed particles of liquid plasticizer. However, in order to insure satisfactory atomization of plasticizer, it is necessary to supply liquid plasticizer to the nozzle 27 or 161 at an elevated pressure. In the apparatus 1, the elevated pressure is produced by the gear pump 32 and by the flow restrictor 29. In the apparatus of FIG. 2, the plasticizer is pressurized by the pump 132 in dependency on the operating speed of the prime mover 113. The pump 132 of FIG. 2 will be preferred when it is desired to convey plasticizer from the main source to the atomizing nozzle (161) substantially without any changes in temperature. The adjustable flow restrictor 29 is likely to raise the temperature of plasticizer in the supply conduit 28. A constant temperature is particularly desirable when the nature of plasticizer is such that its viscosity would change considerably in dependency on changes in temperature. On the other hand, the apparatus of FIG. 1 exhibits the advantage that the nozzle 27 does not have to receive a constant stream of compressed air such as is delivered to the nozzle 161 of FIG. 2 by the conduit 162. It was found that the compressed air stream can be dispensed with if the pump 32 and flow restrictor 29 deliver to the nozzle 27 liquid plasticizer at a sufficiently high pressure. In presently known atomizing systems for liquid plasticizer, it was considered absolutely necessary to admit to the atomizing nozzle a stream of compressed air or another gaseous material. It is often desirable to spray plasticizer without assistance of compressed air, particularly if the compressed air in the nozzle would be likely to adversely affect the condition of plasticizer or its adherence to filaments of the layer of filter material. Of course, the structure of FIG. 2 also exhibits several important advantages. Thus, in addition to the aforementioned feature that the pump 132 need not appreciably raise the temperature of liquid plasticizer in the supply conduit 128, this pump need not deliver the plasticizer at an elevated pressure because the atomizing action is taken over by compressed air which is furnished by the conduit 162. The pressure of air in the conduit 162 can be much less than the pressure of plasticizer in the supply conduit 28 of FIG. 1. The provision of the receptacle 18 or 118 is desirable mainly for the purpose of insuring that the layer 4*a* or 104*a* will not carry away excessive quantities of liquid plasticizer which cannot be retained by the filaments so that such plasticizer would be likely to contaminate the parts of apparatus 1 or 2 in FIG. 1 or parts of apparatus 101 or 102 in FIG. 2.

Figure 3:
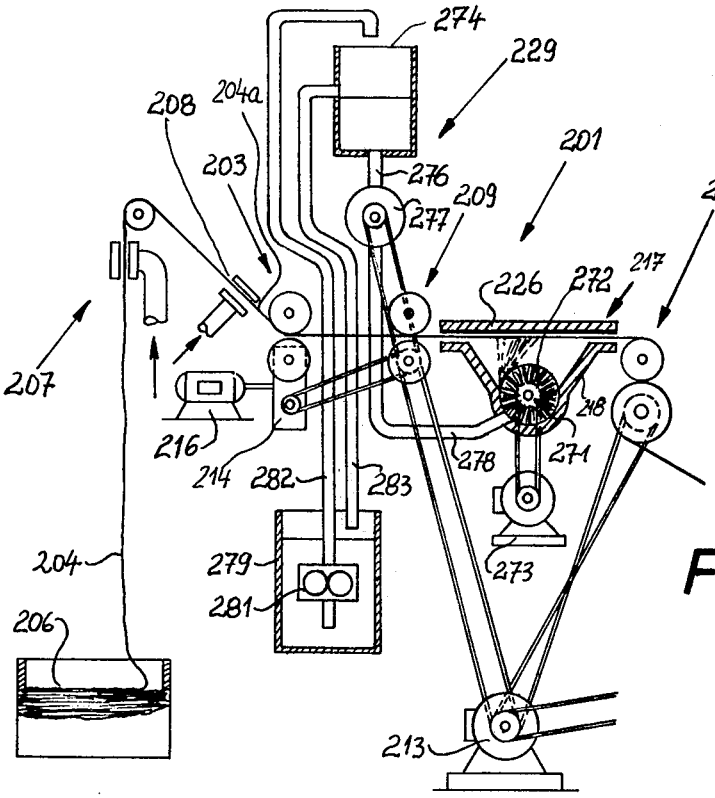
FIG. 3 is a partly elevational and partly vertical sectional view of a third impregnating apparatus.

The impregnating apparatus 201 of FIG. 3 is similar to the apparatus 1 of FIG. 1, and all such components of the apparatus 201 which are clearly analogous to or identical with the corresponding components of the apparatus 1 are denoted by similar reference characters plus 200. The advancing rolls 203 draw a continuous tow 204 of fibrous filter material from the bale 206 and advance successive increments of the tow past two pneumatic banding devices 207, 208. The lower roll 203 is driven by a transmission 214 whose speed ratio is controlled by a variable-speed electric motor 216. The layer 204*a* which is formed by the banding devices 207, 208 and by the specific configuration of rolls 203 is thereupon stretched between the rolls 203 and 209. As explained in connection with FIG. 1, one of each pair of rolls 203, 209 is preferably provided with circumferential grooves and the other roll preferably comprises a peripheral layer of elastomeric material having a smooth external surface. The speed of the rolls 203 is less than the speed of the rolls 209 so as to bring about at least some elongation and attendant straightening of the filaments before they enter the impregnating station 217. This station accommodates an atomizing device 271 which is a rotary brush resembling a cylinder and having a plurality of bristles 272. The brush 271 rotates in the lowermost part of a receptacle 218 and its bristles 272 serve to propel finely atomized particles of plasticizer against the underside of the layer 204*a* during travel of such layer below and in contact with the surface at the underside of an intercepting plate 226. The shaft of the brush 271 is preferably driven by a separate prime mover 273, such as a variable-speed electric motor. The pairs of rolls 203, 209, 211 shown in FIG. 3 are driven by a main prime mover 213 through the intermediary of suitable belt or chain transmissions.

The lower portion of the receptacle 218 receives liquid plasticizer by way of a supply conduit 278 having its inlet end connected to the outlet of a metering element 277 here shown as a variable-delivery pump which forms part of a metering device 229. The inlet of the metering element 277 draws liquid plasticizer from an intermediate vessel 274 which delivers liquid plasticizer to the conduit 276 by gravity flow. The main source of plasticizer is a large vessel or tank 279 from which a pump 281, such as a gear pump, draws a continuous stream of liquid for introduction into the intermediate vessel 274 by way of a conduit 282. In order to insure that the pressure of liquid plasticizer in the intermediate vessel 274 remains constant, the vessel 274 is provided with an overflow opening connected with a return conduit 283 which discharges surplus plasticizer into the main source 279. The metering element 277 is preferably designed in such a way that it does not increase the pressure of plasticizer but merely changes the rate of plasticizer flow in the conduit 278 as a function of changes in the speed of the main prime mover 213. It will be noted that the prime mover 213 drives the metering element 277 by way of a first belt which drives the lower roll 209 and a second belt which receives motion from the lower roll 209 and drives a pulley or sprocket wheel on the shaft of the metering element or pump 277. The pressure of liquid in the conduit 276 can be varied by changing the distance between the intermediate vessel 274 and the inlet of the metering element 277, i.e. by lifting or lowering the vessel 274.

The operation of the impregnating apparatus 201 of FIG. 3 is as follows:

The rolls 203 draw a continuous tow 204 from the bale 206 past the banding devices 207, 208 so that the tow 204 is converted into a foraminous layer 204*a*. Such layer is stretched between the rolls 203, 209 and thereupon enters the impregnating station 217 whereby its increments sweep along the underside of the intercepting plate 226. At the same time, the bristles 272 of the rotating brush 271 propel finely atomized particles of liquid plasticizer which is supplied into the receptacle 218 by the conduit 278. Any such particles of plasticizer which happen to penetrate across the increments of layer 204*a* at the impregnating station 217 are intercepted by the underside of the plate 226 and are swept away by the filaments of the layer 204*a* so that each increment of this layer carries away the same quantity of liquid plasticizer. Since the motor 273 drives the brush 271 at a constant speed, and since the rate at which the metering element 277 supplies liquid plasticizer into the conduit 278 varies as a function of changes in the speed of the main prime mover 213, the quantity of plasticizer delivered to the bristles 272 of the brush 271 is always proportional to the speed of the layer 204*a* at the impregnating station 217. It was found that the rotary brush 271 constitutes an extremely simple but highly reliable atomizing device which further exhibits the important advantage that it is not likely to be clogged. Also, the uniformity of distribution of particles of liquid plasticizer at the underside of the layer 204*a* which travels through the impregnating station 217 is highly satisfactory. Any particles which happen to descend into the lower part of the receptacle 218 automatically return into the range of the rotating bristles 272 and are again propelled against the underside of the layer 204*a*.

Figure 4:
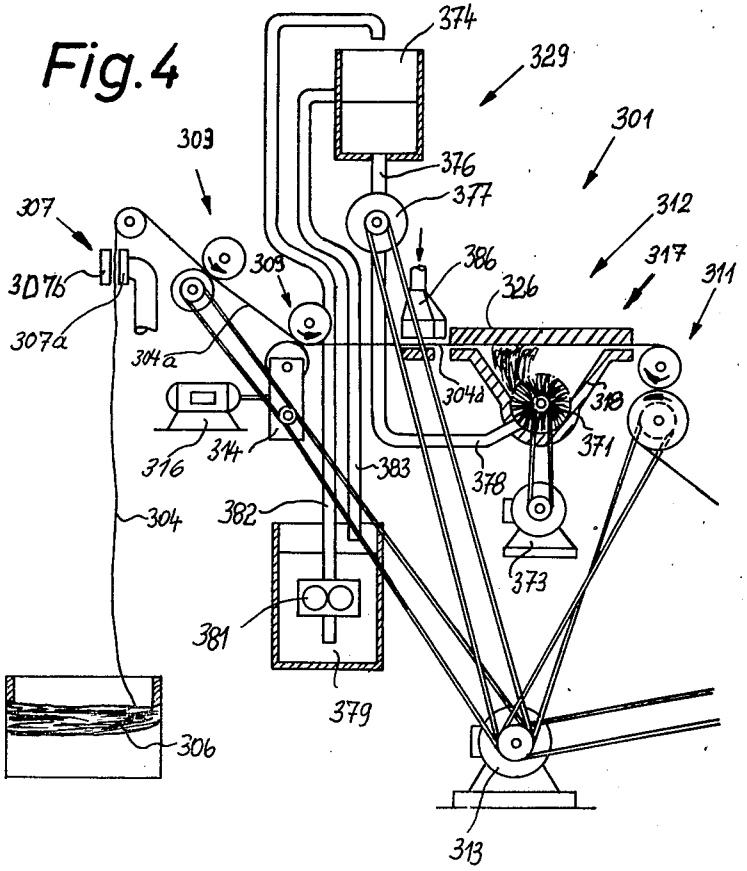
FIG. 4 is a similar partly elevational and partly vertical sectional view of a fourth impregnating apparatus.

Referring to FIG. 4, there is shown an impregnating apparatus 301 which constitutes a further modification of the apparatus shown in FIGS. 1 to 3. A main feature of the apparatus of FIG. 4 is that one of the banding devices is mounted immediately upstream of the impregnating station 317. This is often desirable because the layer 304*a* is likely to change its shape, particularly its thickness and its width, during travel from the last banding device to the impregnating station, especially if the last banding device is located at a considerable distance from the location where successive increments of the layer are contacted by particles of atomized plasticizer. The uniformity of distribution of particles of plasticizer is improved if the layer which reaches the impregnating station 317 is a relatively thin layer having uniformly or substantially uniformly distributed loose filaments of filter material so that each such filament can be contacted by one or more particles of liquid plasticizer.

As a rule, a banding device comprises a nozzle which discharges several streamlets of compressed air and a baffle which is located opposite the orifices of the nozzle and serves as a means for causing the streamlets to rebound on its surface to thereby further promote the loosening of filaments in the travelling tow. As shown in the left-hand portion of FIG. 4, the banding device 307 comprises a nozzle 307*a* having a large number of orifices which discharge small streams of compressed air received from a suitable compressor, not shown. The orifices are located opposite a stationary baffle 307*b* on which the streamlets of air rebound and again penetrate into the flattened tow 304 so as to convert such tow into the layer 304*a*. The operation of the banding device is quite satisfactory; however, the streamlets of air which rebound on the baffle 307*b* are likely to be entrained by the layer 304*a* and to enter the impregnating station 317 where they could interfere with uniformity of distribution of liquid plasticizer in successive increments of the layer.

The construction of the impregnating apparatus 301 is practically identical with that of the apparatus shown in FIG. 3 and all such parts of this apparatus which are clearly identical with the corresponding parts of the apparatus 201 are denoted by similar reference characters plus 100. The only difference is that the distance between the rolls 309 and the receptacle 318 at the impregnating station 317 is increased so as to provide room for a second banding device 386 which replaces the banding device 208 of FIG. 3. The details of the banding device 386 are illustrated in FIG. 5.

The brush 371 is driven by a separate prime mover 373 and receives liquid plasticizer by way of the conduit 378 which in return receives plasticizer from the metering element 377. The latter is driven at a speed which is proportional with the speed of forward movement of the layer 304*a* and receives liquid plasticizer from the intermediate vessel 374. The level of liquid plasticizer in the vessel 374 is maintained unchanged by the return conduit 383 which delivers surplus plasticizer into the main source 379. The main source 379 accommodates a pump 381 which supplies liquid plasticizer to the intermediate vessel 374 by way of the conduit 382. The speed of the lower roll of the pair of rolls 309 can be changed by the transmission 314 which is controlled by the variable-speed electric motor 316.

Figure 5:
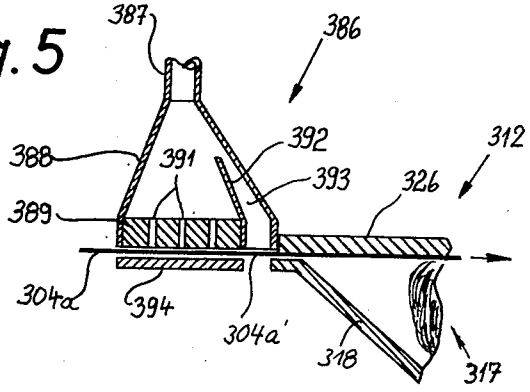
FIG. 5 is an enlarged sectional view of a detail in the apparatus of FIG. 4.

Referring now to FIG. 5, the banding device 386 comprises a funnel-shaped nozzle 388 having a plate or wall 389 provided with a large number of small orifices 391. These orifices discharge streamlets of compressed air which is supplied to the nozzle 388 by way of a conduit 387. The streamlets of compressed air impinge upon the upper side of the layer 304*a* and thereupon rebound on a stationary baffle 394 located below the path of the layer 304*a*. The travelling layer 304*a* is likely to entrain the rebounding air into the receptacle 318 at the impregnating station 317 whereby such air could interfere with proper distribution of particles of liquid plasticizer among the filaments of the layer 304*a*. In accordance with a feature of the invention, the nozzle 388 is provided with a partition 392 which serves as a means for directing a current of air through a channel 393 of the nozzle 388 and across the layer 304*a'* immediately downstream of the baffle 394 and immediately upstream of the receptacle 318. The current of air which is discharged by way of the channel 393 entrains any air which might have been entrapped in the layer 304*a'* to thus prevent such air from entering the impregnating station 317. The streamlets of air which issue from the orifices 391 bring about a desirable flattening and widening of the layer 304*a* so that the layer 304*a'* downstream of the baffle 394 is in an optimum condition for contact with particles of atomized plasticizer. The current of air which issues from the relatively wide channel 393 constitutes a barrier against penetration of air (which was discharged via orifices 391) into the receptacle 318 and into the range of particles of liquid plasticizer furnished by the bristles of the rotating brush 371.

The specific construction of the banding device 386 of FIG. 5 renders it possible to mount this device immediately upstream of the impregnating station without unduly affecting the operation of the atomizing device 371. On the other hand, such placing of the banding device 386 into very close proximity of the impregnating station 317 renders it possible to insure that the layer 304*a'* which enters the impregnating station is in an optimum condition for reception and retention of a large number of atomized liquid particles. The statement that the banding device 386 is located close to and upstream of the impregnating station 317 is intended to cover all such positions of this banding device which would result in entrainment of at least some of the loosening air streamlets into the impregnating station in the absence of a barrier, such as the current of air which is discharged by way of the channel 393 and flows across successive increments of the layer 304*a'* before such increments enter the receptacle 318. In the absence of the channel 393, the air which is furnished by the orifices 391 would expel some of the liquid plasticizer which is furnished by the rotating brush 371.

Figure 6:
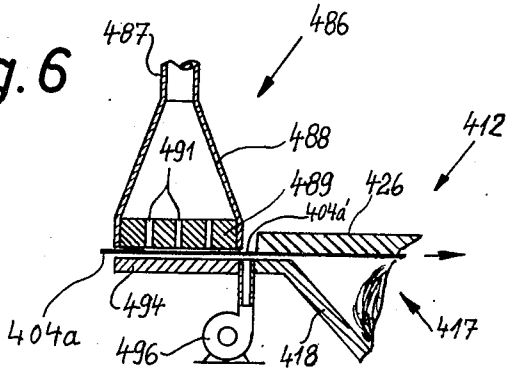
FIG. 6 is a sectional view of a modification of the structure shown in FIG. 5.

Referring finally to FIG. 6, there is shown a modified banding device 486 which constitutes a modification of the banding device 386 of FIG. 5. The banding device 486 comprises a funnel-shaped nozzle 488 having a wall 489 with orifices 491 which discharge streamlets of compressed air against the upper side of the layer 404*a* of fibrous filter material. The layer 404*a* is equalized and converted into a layer 404*a'* by the streamlets of air which issue from the orifices 491 and rebound on the baffle 494. The partition 392 and the channel 393 of FIG. 5 are replaced by a suction fan 496 which draws a current of air across the layer 404*a*′ immediately upstream of the impregnating station 417. The current of air which is produced by the fan 496 is a functional equivalent of the current of compressed air furnished by the channel 393 of FIG. 5. The impregnating device 412 at the station 417 includes a receptacle 418 for a rotary brush, not shown, and an intercepting plate 426 which is mounted opposite the brush and insures that any such particles of liquid plasticizer which happen to penetrate through the foraminous layer 404*a*′ are entrained by successive increments of such layer while the increments sweep along the underside of the plate 426. The reference character 487 denotes a conduit which supplies compressed air to the nozzle 488.

An important advantage of the improved impregnating apparatus is that all or nearly all particles of atomized liquid plasticizer which are directed against successive increments of the travelling layer 4*a*, 104*a*, 204*a*, 304*a*′ or 404*a*′ are invariably entrained by the fibrous material of the layer. Consequently, by properly metering the quantity of plasticizer per unit length of the tow, one can determine with a high degree of accuracy the amount of plasticizer which is taken up by unit lengths of the layer leaving the impregnating station. Therefore, the hardness of filter plugs or filter rod sections which are produced in the associated filter rod section making apparatus (such as the apparatus 2 of FIG. 1) is always within the desired range to thus insure that the filter rod sections are neither damaged nor deformed during processing in a filter cigarette making machine or the like.

Another important advantage of the improved impregnating apparatus is that the rate of delivery of liquid plasticizer to the atomizing device changes as a function of changes in the speed of lengthwise movement of the tow. This also contributes to uniformity of hardness of the filter rod sections. Furthermore, such dependence of the rate of admission of liquid plasticizer to the atomizing device on the changes in speed of the travelling layer of fibrous filter material renders it unnecessary to make any manual adjustments at the impregnating station when the speed of the tow is changed.

The apparatus shown in FIGS. 4–5 and 6 exhibit the additional important advantage that the layer 304*a*′ or 404*a*′ is in an optimum condition when it enters the impregnating station 317 or 417. This is attributed to the provision of the barrier which may either constitute a current of compressed air issuing from the channel 393 or a current of air which is drawn by the fan 496. Such optimum conditioning of the layer 304*a*′ or 404*a*′ can be achieved without allowing any surplus air to enter the impregnating station and to interfere with the distribution of particles of liquid plasticizer on the filaments of fibrous filter material.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended:

1. Apparatus for applying fluid plasticizer to the filaments in layers of fibrous filter material, comprising advancing means for moving a foraminous layer of fibrous filter material along a predetermined path toward, and beyond an impregnating station; a source of plasticizer; an atomizing device located at said station at one side of said path and connected with said source so as to directly propel against each zone of each successive increment of the moving layer at said station a spray of particles of finely distributed plasticizer whereby some of the particles adhere to the filaments and the remaining particles penetrate across such increments; and intercepting means having a surface which is impermeable to fluids in its entirety and is immediately adjacent to said path opposite said atomizing device so that successive increments of the moving layer sweep along said surface and entrain at least some of said remaining particles.

2. Apparatus as defined in claim 1, wherein said atomizing device includes at least one nozzle having orifices for discharge of plasticizer directly against the layer at said station.

3. Apparatus as defined in claim 2, further comprising a source of compressed gaseous atomizing fluid and conduit means connecting said last-mentioned source with said nozzle.

4. Apparatus as defined in claim 1, further comprising a receptacle provided at said station and defining at least one chamber for collection of those particles of atomized plasticizer which are not entrained by the moving layer of filter material.

5. Apparatus for applying fluid plasticizer to the filaments in layers of fibrous filter material, comprising advancing means for moving a foraminous layer of fibrous filter material along a predetermined path toward, through and beyond an impregnating station, said advancing means including variable-speed drive means for the layer of fibrous material; a source of plasticizer; an atomizing device located at said station at one side of said path and connected with said source so as to directly propel against each zone of each successive increment of the moving layer at said station a spray of particles of finely distributed plasticizer whereby some of the particles adhere to the filaments and the remaining particles penetrate across such increments; means for regulating the rate of delivery of plasticizer from said source to said atomizing device as a function of changes in the speed of the layer at said station; and intercepting means having a surface immediately adjacent to said path opposite said atomizing device so that successive increments of the moving layer sweep along said surface and entrain at least some of said remaining particles.

6. Apparatus as defined in claim 5, wherein said regulating means includes conduit means connecting said source with said atomizing device, adjustable flow restrictor means and control means for adjusting said flow restrictor means as a function of changes in the speed of the layer at said station.

7. Apparatus as defined in claim 5, wherein said regulating means comprises conduit means connecting said source with said atomizing device and variable-delivery pump means in said conduit means.

8. Apparatus for applying fluid plasticizer to the filaments in layers of fibrous filter material, comprising advancing means for moving a foraminous layer of fibrous filter material along a predetermined path towards, through and beyond an impregnating station; a source of plasticizer; an atomizing device located at said station at one side of said path and connected with said source so as to directly propel against each zone of each successive increment of the moving layer at said station a spray of particles of finely distributed plasticizer whereby some particles penetrate across such increments; intercepting means having a surface immediately adjacent to said path opposite said atomizing device so that successive increments of the moving layer sweep along said surface and entrain at least some of said remaining particles; and a receptacle provided at said station and defining at least one suction chamber for collection of those particles of atomized plasticizer which are not entrained by the moving layer of filter material.

9. Apparatus for applying fluid plasticizer to the filaments in layers of fibrous filter material, comprising advancing means for moving a foraminous layer of fibrous filter material along a predetermined path toward, through and beyond an impregnating station; a source of plasticizer; an atomizing device located at said station at one side of said path and connected with said source so as to directly propel against each zone of each successive increment of the moving layer at said station a spray of particles of finely distributed plasticizer whereby some of the particles adhere to the filaments and the remaining particles penetrate across such increments, said atomizing device comprising at least one rotary brush having orbiting bristles and conduit means for supplying plasticizer into the range of said bristles; and intercepting means having a surface immediately adjacent to said path opposite said atomizing device so that successive increments of the moving layer sweep along said surface and entrain at least some of said remaining particles.

10. Apparatus as defined in claim 9, wherein said conduit means is arranged to supply plasticizer at a pressure exceeding atmospheric pressure.

11. Apparatus for applying fluid plasticizer to the filaments in layers of fibrous filter material, comprising advancing means for moving a foraminous layer of fibrous filter material along a predetermined path toward, through and beyond an impregnating station; a pneumatic banding device closely adjacent to and located upstream of said station, said banding device including nozzle means arranged to discharge streams of a gaseous fluid across successive increments of the moving layer of filter material and to thereby increase the width of such increments prior to entry into said station; a source of plasticizer; an atomizing device located at said station at one side of said path and connected with said source so as to directly propel against each zone of each successive increment of the moving layer at said station a spray of particles of finely distributed plasticizer whereby some of the particles adhere to the filaments and the remaining particles penetrate across such increments; and intercepting means having a surface immediately adjacent to said path opposite said atomizing device so that successive increments of the moving layer sweep along said surface and entrain at least some of said remaining particles.

12. Apparatus as defined in claim 11, wherein said nozzle means is located at one side of said path, said banding device further comprising baffle means disposed at the other side of said path to deflect the streams of air in the direction of movement of the layer toward said station, said banding device also comprising means for changing the direction of the thus deflected air streams between said nozzle means and said station so that such air cannot interfere with impregnation of filaments by particles of plasticizer at said station.

13. Apparatus as defined in claim 12, wherein said direction changing means forms part of said nozzle means and includes means for directing a current of air across the layer between said baffle means and said station.

14. Apparatus as defined in claim 13, wherein said direction changing means comprises an internal partition of said nozzle means.

15. Apparatus as defined in claim 12, wherein said direction changing means comprises a suction generating device arranged to draw a current of air across the layer between said baffle means and said station.

* * * * *